US007299863B2

(12) United States Patent
Lee et al.

(10) Patent No.: US 7,299,863 B2
(45) Date of Patent: Nov. 27, 2007

(54) LOUVER FIN TYPE HEAT EXCHANGER HAVING IMPROVED HEAT EXCHANGE EFFICIENCY BY CONTROLLING WATER BLOCKAGE

(75) Inventors: Dae-Young Lee, Seoul (KR); Hyun-Seon Choo, Jeollanam-Do (KR)

(73) Assignee: Korea Institute of Science and Technology (KR)

( * ) Notice: Subject to any disclaimer, the term of this patent is extended or adjusted under 35 U.S.C. 154(b) by 147 days.

(21) Appl. No.: 11/311,498

(22) Filed: Dec. 19, 2005

(65) Prior Publication Data

US 2006/0283581 A1 Dec. 21, 2006

(30) Foreign Application Priority Data

Jun. 17, 2005 (KR) ..... 10-2005-0052629

(51) Int. Cl.
*F28D 1/03* (2006.01)

(52) U.S. Cl. ..... 165/152; 165/166; 165/913

(58) Field of Classification Search ..... 165/152, 165/166, 70, DIG. 197, DIG. 185, 913
See application file for complete search history.

(56) References Cited

U.S. PATENT DOCUMENTS 4,580,624 A * 4/1986 Ishida et al. ..... 165/152
4,756,362 A * 7/1988 Kudoh et al. ..... 165/151
5,787,972 A * 8/1998 Beamer et al. ..... 165/152
2002/0195235 A1* 12/2002 Falta et al. ..... 165/152
2004/0031595 A1* 2/2004 Iwasaki et al. ..... 165/135
2004/0050531 A1* 3/2004 Horiuchi et al. ..... 165/41
2004/0069457 A1* 4/2004 Park et al. ..... 165/104.21
2005/0006063 A1* 1/2005 Zhang ..... 165/152

* cited by examiner

*Primary Examiner*—Teresa J. Walberg
(74) *Attorney, Agent, or Firm*—Ostrolenk, Faber, Gerb & Soffen, LLP

(57) ABSTRACT

Disclosed is a louver fin type heat exchanger positioned upright at a certain angle with respect to the ground, wherein lower end portions of louver fins close to the ground are bent toward lower end portions of adjacent louver fins, such that the air passage at the lower end portion close to the ground has cross-section areas that are wide at certain portions and are narrow at other portions thereof. Accordingly, moisture congregates only at a portion where the cross-section of the air passage is great, so that the external air smoothly passes into or out the heat exchanger through the air passage where the moisture congregation does not occur, minimizing the pressure drop, and efficiency in heat exchange of the heat exchanger can be thusly improved.

19 Claims, 7 Drawing Sheets

LOUVER FIN TYPE HEAT EXCHANGER HAVING IMPROVED HEAT EXCHANGE EFFICIENCY BY CONTROLLING WATER BLOCKAGE

BACKGROUND OF THE INVENTION

1. Field of the Invention

The present invention relates to a louver fin type heat exchanger, and particularly, to a louver fin type heat exchanger having high reliability and improved efficiency by securely obtaining the air passageway in the heat exchanger, by minimizing a pressure drop of the air flow, and by controlling congregating of water drops formed by condensation (i.e., water blockage) at lower end portions of air passages of the louver fin type heat exchanger positioned upright at a certain angle with respect to the ground.

2. Description of the Background Art

In general, heat exchange between fluids is essential in a number of processes of heat-related industry. Therefore, various types of heat exchangers having improved efficiency in a heating system through effective heat exchange are being used. Of the heat exchangers, a heat exchanger used for a home air conditioner, an engine coolant system of a car, an air conditioning system of a car or the like, has fins securing a wider heat transfer area in order for the heat exchange with the external air.

Recently, the use of a compact heat exchanger having fins having a heat transfer area of about 100 $m^2/m^3$ or more is started according to demands for a leaner and lighter heat exchanger. The compact heat exchanger is divided into a plate-fin heat exchanger and a fin-tube heat exchanger. As the compact heat exchanger used in an air conditioning system, the fin-tube type heat exchanger was generally used. However, because the fin-tube type heat exchanger is problematic in that its weight is increased due to a copper pipe provide thereto and recycling of a material is difficult because materials of a fin and a tube are different, the fin-tube type heat exchanger is being replaced with the plate-fin type heat exchanger in the field of a package air conditioner and an air conditioning system for a car, which require to be leaner and lighter.

As shown in FIG. 1 to 3, a louver fin type heat exchanger 1, which is one of plate-fin type heat exchangers whose usable range is gradually increasing, includes two or more plates 10 and 20 formed of a metallic material and spaced apart from each other at a predetermined interval, a louver fin unit 30 coupled with the plates 10 and 20 and having at least one louver fin, and an air passage 40 formed between the plates 10 and 20 and the louver fin unit 30 for the purpose of allowing heat exchange between external air and the louver fin 30 or the like.

As shown in FIGS. 2 and 3, the louver fin 30 includes a plurality of louvers 31*a* bent at a predetermined angle to induce an air flow, and a plurality of through holes 31 between the louvers 31*a* to communicate with the air passages 40, thereby contributing to effective heat exchange between the air introduced from the outside and the louver fin 30.

Although FIG. 1 shows the louver fin type heat exchanger 1 in which one louver fin unit 30 is coupled between two plates 10 and 20, substantially, the plate-fin type heat exchanger to which the louver fin unit 30 is applied is constructed such that louver fins 30 are respectively bonded between a few plates 10, 20 or between several tens of plates 10, 20.

By such a construction, the air introduced from the outside in a first air-flow direction or a second air-flow direction passes between the plates 10, 20 and the louver fin unit 30, exchanging heat with the plates 10 and 20 and the louver fin unit 30. In such a manner, the heat of the plates 10 and 20 and the louver fin 30 is released to the outside or introduced thereinto.

However, if the louver fin type heat exchanger 1 (not shown) is positioned upright at a predetermined angle with respect to the ground and is simultaneously used as a freezer evaporator or the like, the air introduced into the heat exchanger is condensed while passing through the cool air passages 40 and moisture 90 flows down toward the ground by gravity. Thus, as shown in FIG. 4, moisture 99 irregularly congregates (i.e., water blockage occurs) on lower end portions of the louver fin unit 30 close to the ground. Here, because the moisture congregating on the lower end portions of the louver fin 30 blocks the air passage 40, the introduction to the air passage 40 or outflow of the air from the air passage 40 is not smoothly made, which causes an increase in a pressure drop of the air passing through the heat exchanger 1 and accordingly deteriorates heat exchange efficiency of the heat exchanger 1.

Furthermore, even though the heat exchanger is not used for the freezer evaporator in which the external air should pass through the cool air passage, the aforementioned problem may occur even when the louver fin type heat exchanger positioned upright at a predetermined angle with respect to the ground is used for a freezer condenser, a radiator, an oil cooler or the like and evaporation water is sprayed or dropped to improve cooling performance by an evaporation cooling effect. For this reason, a need to solve such problems is increasing.

In order to solve such problems, there was an attempt to reduce congregating moisture (i.e., water blockage) by reducing a contact angle between water and a fin by hydrophilic surface coating on a surface of the fin. Thus, as shown in FIG. 5, the extent to which the moisture congregates at the lower end portions of the louver fin 30 can be reduced as compared to the case where the hydrophilic surface coating is not performed. However, when a gap between the plates is 5 mm or less, the water blockage still occurs.

Particularly, from the view on the tendency that the gap is getting smaller in response to the demand for a smaller heat exchange, it can be known through the experiment of FIG. 5 that there is a limit in improving performance of the louver fin type heat exchanger only by hydrophilic coating.

As another solution for the congregating moisture of the louver fin type heat exchanger, research is conducted on reducing a contact angle between a fin and moisture by fabricating a porous fin with fine metal powder. However, this method is also problematic in that the moisture still congregates when pitches between fins are 5 mm or less.

BRIEF DESCRIPTION OF THE INVENTION

Therefore, an object of the present invention is to provide a louver fin type heat exchanger having high reliability and improved heat-exchange efficiency by stably securing a smooth air flow within the louver fin type heat exchanger by controlling water blockage at lower end portions of the louver fin type heat exchanger at a predetermined angle with respect to the ground.

Another object of the present invention is to provide a louver fin type heat exchanger which can effectively applied to a freezer evaporator, a condenser using an evaporator cooling effect, a radiator or the like even when intervals between fins are small due to small pitches of the heat exchanger, by preventing a phenomenon where a pressure loss of the air is increased because flow resistance of the air passing through the louver fin type heat exchanger is increased by the water blockage occurring at the lower end portions of the louver fin unit and where performance of the heat exchanger is deteriorated because the flow of the air passing through the louver fin type heat exchanger is decreased.

To achieve these and other advantages and in accordance with the purpose of the present invention, as embodied and broadly described herein, there is provided a louver fin type heat exchanger comprising two or more plates respectively spaced apart from each other and positioned upright at a certain angle with respect to the ground, and a louver fin unit with a wave-pattern cross-section inserted between the plates, whereby an air passage is formed in the spaces between the plates and each louver fin of the louver fin unit, the heat exchanger characterized in that the louver fin unit having at least one louver fin with a lower end portion close to the ground being formed to be bent towards an adjacent louver, such that the air passage at the lower end portion close to the ground has cross-section areas that are wide at certain portions and are narrow at the other portions thereof.

Thusly, the air passages at a side close to the ground which are formed by being surrounded by the plates and the louver fins have different cross-section areas, such that moisture congregates only at the air passage with a small cross-section area and does not congregate at the air passage with a large cross-section area. Accordingly, minimizing the pressure drop, the external air smoothly passes into or out the heat exchanger through the air passage where the moisture does not congregate, thereby improving heat exchange efficiency of the louver fin heat exchanger.

A plurality of through holes are formed on the louver fins, and the air introduced into the heat exchanger through the through hole is uniformly spread to an adjacent air passage where an air flow is not active due to the moisture congregating at a lower end portion, thereby obtaining high efficiency in heat exchange.

Here, the lower end portions of the louver fins close to the ground are bent toward the lower end portions of adjacent louver fins to be closer together or further apart in an alternating manner, such that the cross-section areas of the lower end portions of the air passage close to the ground are alternatingly narrower and wider. Thusly, the pressure drop of the air passing into or out the heat exchanger can be minimized.

If intervals between louver fins are smaller to minimize the heat exchanger, moisture may congregate even at lower end portions of the louver fins with wider cross-section areas. Therefore, the lower end portions of the louver fins close to the ground is formed to be longer than the lower end portions of other louver fins so as to have an offset (d). In such a manner, the moisture can be prevented from congregating at the lower end portions of the louver fins having the wider cross-section areas.

Here, the lengths of the lower end portions of the louver fins close to the ground are longer than or shorter than the lengths of the lower end portions of adjacent louver fins, such that the lengths of the air passages of the lower end portions close to the ground are alternatingly longer and shorter.

Effectively, an offset (d) between the long lower end portion and the short lower end portion of the louver fins is 3 mm or greater.

Thusly, although moisture congregates at the lower end portions of the louver fins, the air can flow between positions where the water congregates, so that a pressure loss of the air passing through the louver fin type heat exchanger can be minimized.

The present invention is proposed on the assumption that moisture congregating within the heat exchanger or spreading from the outside moves toward a portion close to the ground by the gravity. Accordingly, the present invention can obtain the greatest effect when the louver fin type heat exchanger is positioned upright at an angle, which is almost perpendicular to the ground, for example, 75°~90°.

Hydrophilic surface coating may be performed on a surface of one of the plates and the louver fin unit in order to reduce a contact angle with the moisture. Also, preferably, the plates and the louver fin unit are made of an aluminum material having high heat conductivity.

According to the present invention, even a compact louver fin type heat exchanger in which a gap of the plates or intervals between the louver fins are 0.5 mm~5 mm which is small, can secure improved efficiency of the heat exchange because the pressure drop of the air passing through the heat exchanger can be minimized.

Herein, the lower end portions of the louver fins close to the ground are bent towards the lower end portions of adjacent louver fins to be closer together or further apart in an alternating manner, such that the cross-section areas of the lower end portions of the air passage close to ground are alternatingly narrower and wider.

A plurality of flow passages are formed between the louvers on the louver fins so as to allow the air to flow between the finned channels.

Herein, the lower end portions close to the ground of a part of louver fins are longer than those of the other louver fins. Further, the lower end portions close to the ground of a part of the louver fins are longer than or shorter than those of adjacent louver fins, such that the lengths of the air passages of the lower end portions close to the ground are alternatingly longer and shorter.

Also, the plates are positioned upright at an angle of 75°~90° with respect to the ground. And the gap between the fins is 0.5 mm~5 mm, and the plates and the louver fins are made of an aluminum material.

The hydrophilic surface coating is performed on at least one of the plates and the louver fin unit.

The louver fin type heat exchanger further comprises two or more plates respectively spaced apart from each other and positioned upright at a certain angle with respect to the ground, and a louver fin unit with a wave-pattern cross-section inserted between the plates, whereby an air passage is formed in the spaces between the plates and each louver fin of the louver fin unit, the heat exchanger characterized in that the lower end portions close to the ground of a part of louver fins are longer than those of the other louver fins.

Herein, the lower end portions close to the ground of the louver fins are longer than or shorter than the those of adjacent louver fins, such that the lower end portions close to the ground are alternatingly longer and shorter. And, the length difference between the louver fins is 3 mm or greater.

Also, a plurality of flow passages are formed between the louvers on the louver fins so as to allow the air to flow between the finned channels.

The lower end portions of the louver fins close to the ground are bent toward the lower end portions of adjacent louver fins, such that the air passage at the lower end portion close to the ground has cross-section areas that are wide at certain portions and are narrow at other portions thereof.

The lower end portions of the louver fins close to the ground can be bent toward the lower end portions of adjacent louver fins to be closer together or further apart in an alternating manner, such that the cross-section areas of the lower end portions of the air passage close to the ground are alternatingly narrower and wider.

Herein, the plates are positioned upright at an angle of 75°~90° with respect to the ground. And, the hydrophilic surface coating is performed on at least one of the plates or the louver fin unit, an interval between the fins is 0.5 mm~5 mm.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings:

FIGS. 6 to 10C are views which illustrate a louver fin type heat exchanger in accordance with one embodiment of the present invention, wherein FIGS. 6 and 7 are schematic views which illustrate a sectional shape of the louver fin taken along line A-A of FIG. 1, FIG. 8 is a graph which illustrates an experimental result of measuring a pressure drop according to the shape of the louver fin of FIG. 6, FIG. 9 is a perspective view of FIG. 6, FIG. 10C is a sectional view of the louver fin taken along line D-D of FIG. 9; and FIGS. 11 and 12 are views which illustrate the louver fin type heat exchanger in accordance with another embodiment of the present invention, wherein FIG. 11 is a schematic view which illustrates a sectional shape of the louver fin taken along line A-A of FIG. 1, and FIG. 12 is data of an experiment on measuring a height of congregating moisture according to the shape of the louver fin of FIG. 11.

DETAILED DESCRIPTION OF THE INVENTION

Reference will now be made in detail to the preferred embodiments of the present invention, examples of which are illustrated in the accompanying drawings.

Figure 1:
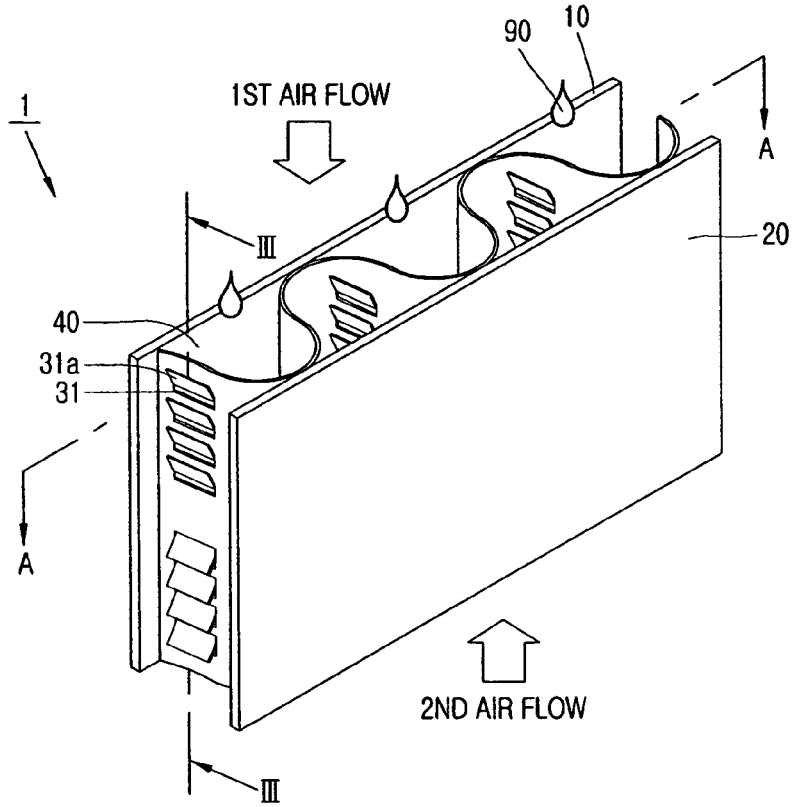
FIG. 1 is a partial perspective view which illustrates a structure of a louver fin type heat exchanger in which an air flow is made in a vertical direction.
Figure 2:
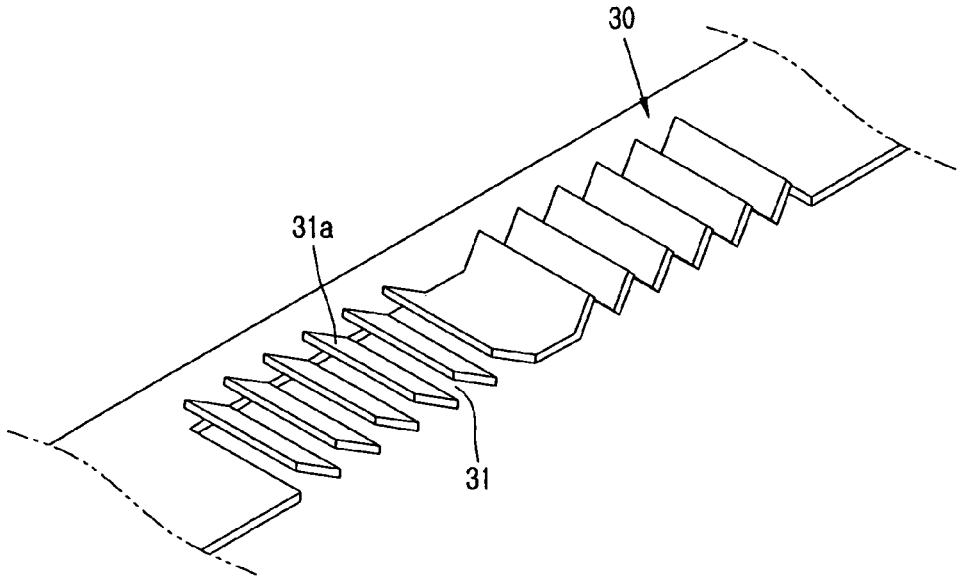
FIG. 2 is an enlarged perspective view which illustrates a shape of a louver fin of FIG. 1.
Figure 3:
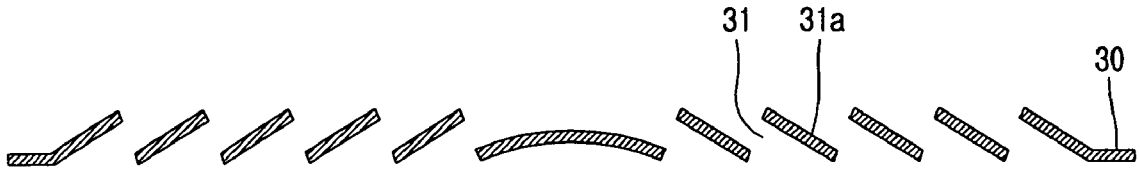
FIG. 3 is a sectional view taken along line III-III of FIG. 1.
Figure 4:
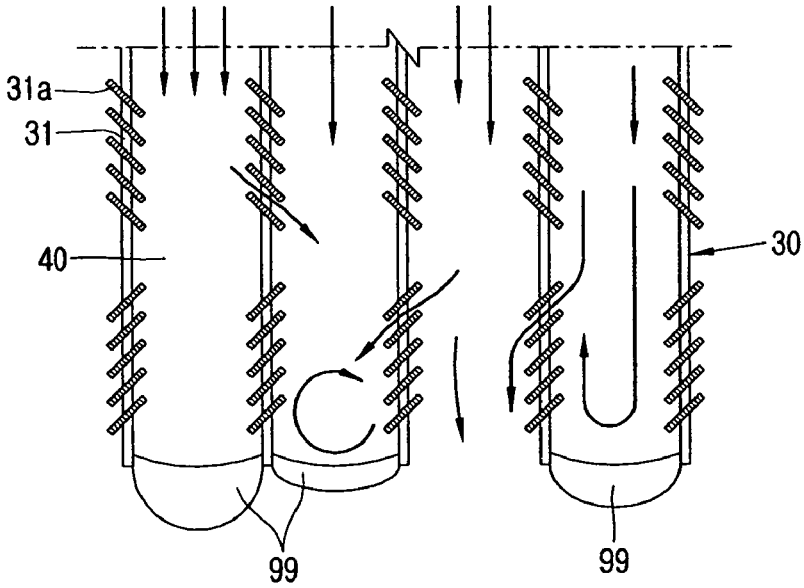
FIG. 4 is a schematic view which illustrates a sectional shape of the conventional louver fin in which an air passage is blocked by moisture congregating at lower end portions of the louver fin.
Figure 5:
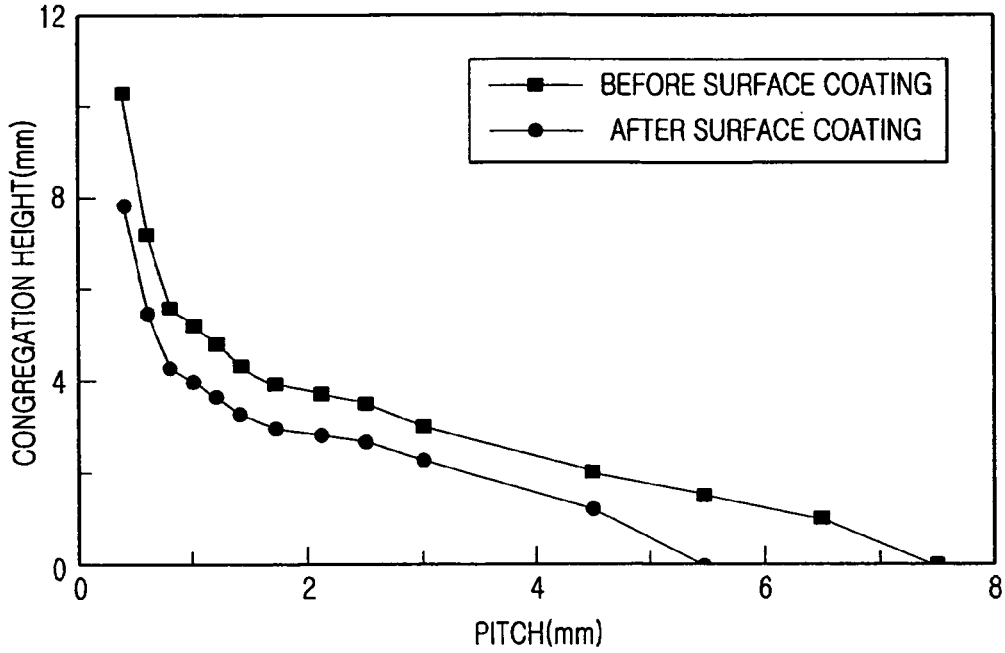
FIG. 5 is a graph which illustrates an experimental result of measuring a height of congregating moisture according to a pitch before and after performing a hydrophilic surface treatment on the louver fin of FIG. 1.
Figure 6:
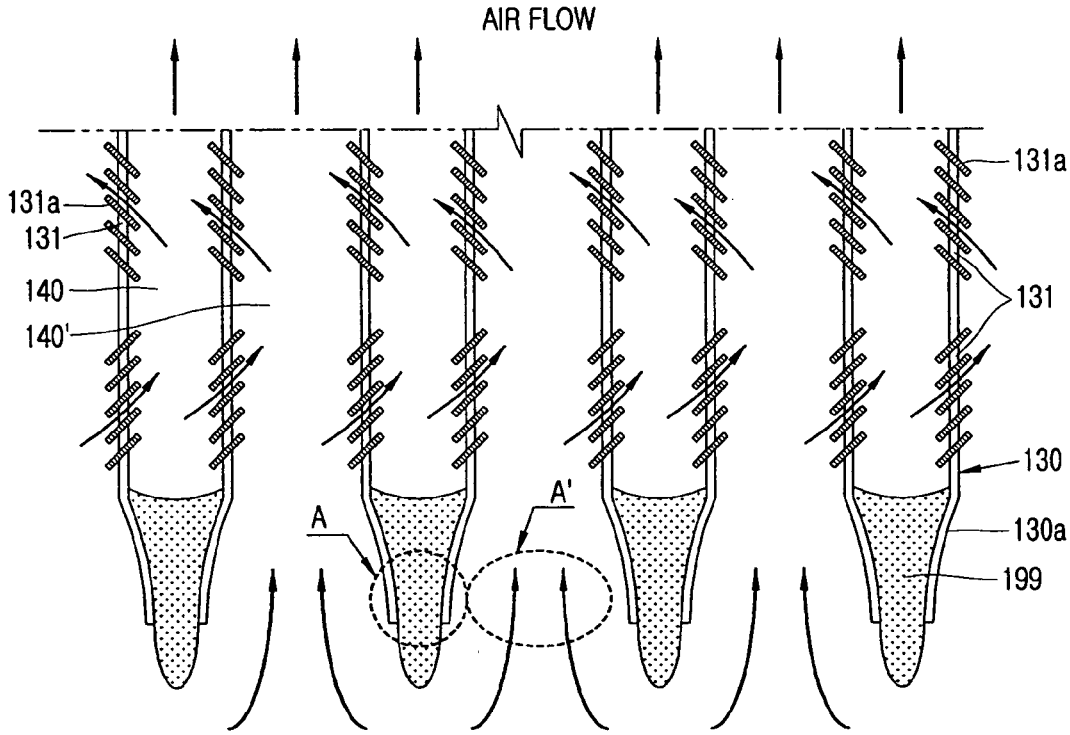
Figure 7:
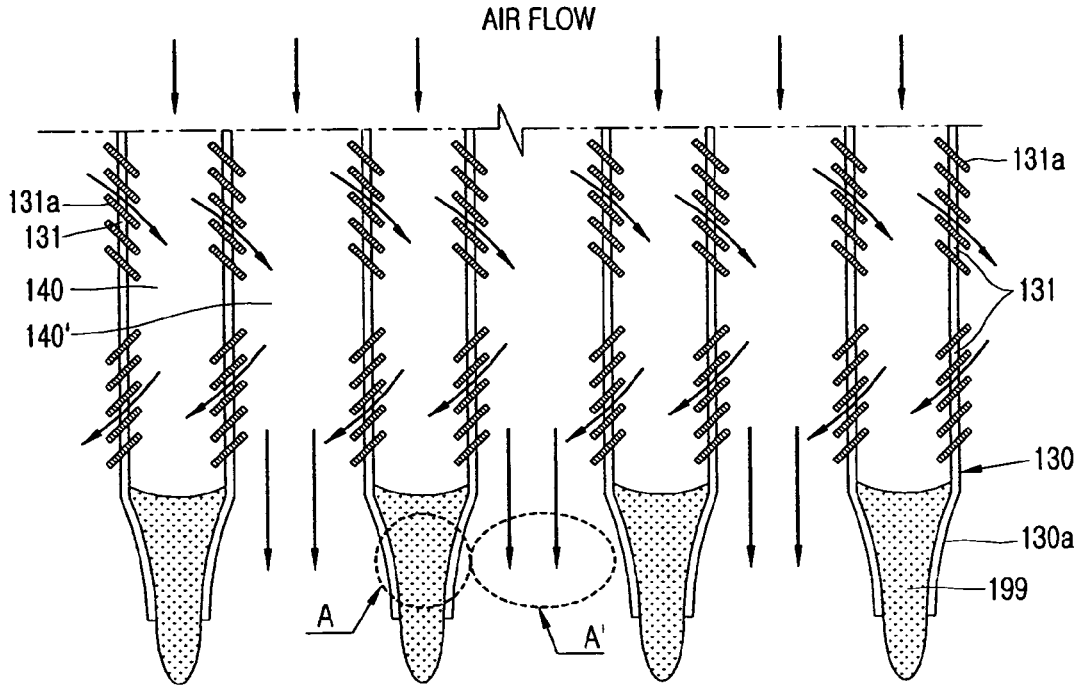
Figure 8:
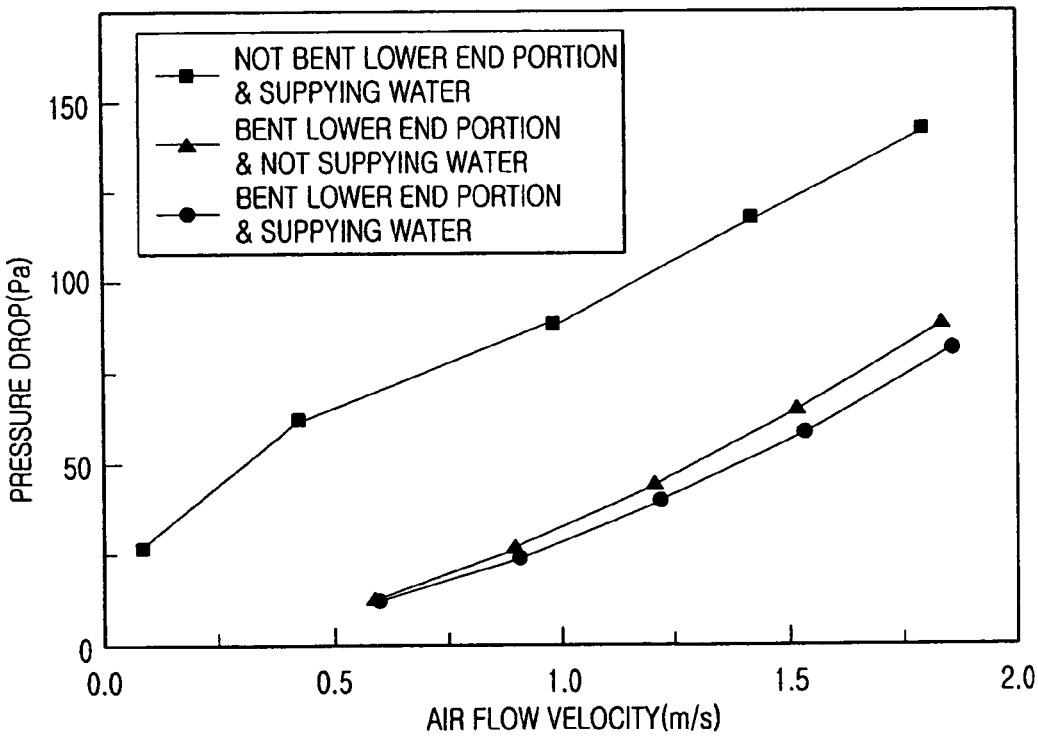
Figure 9:
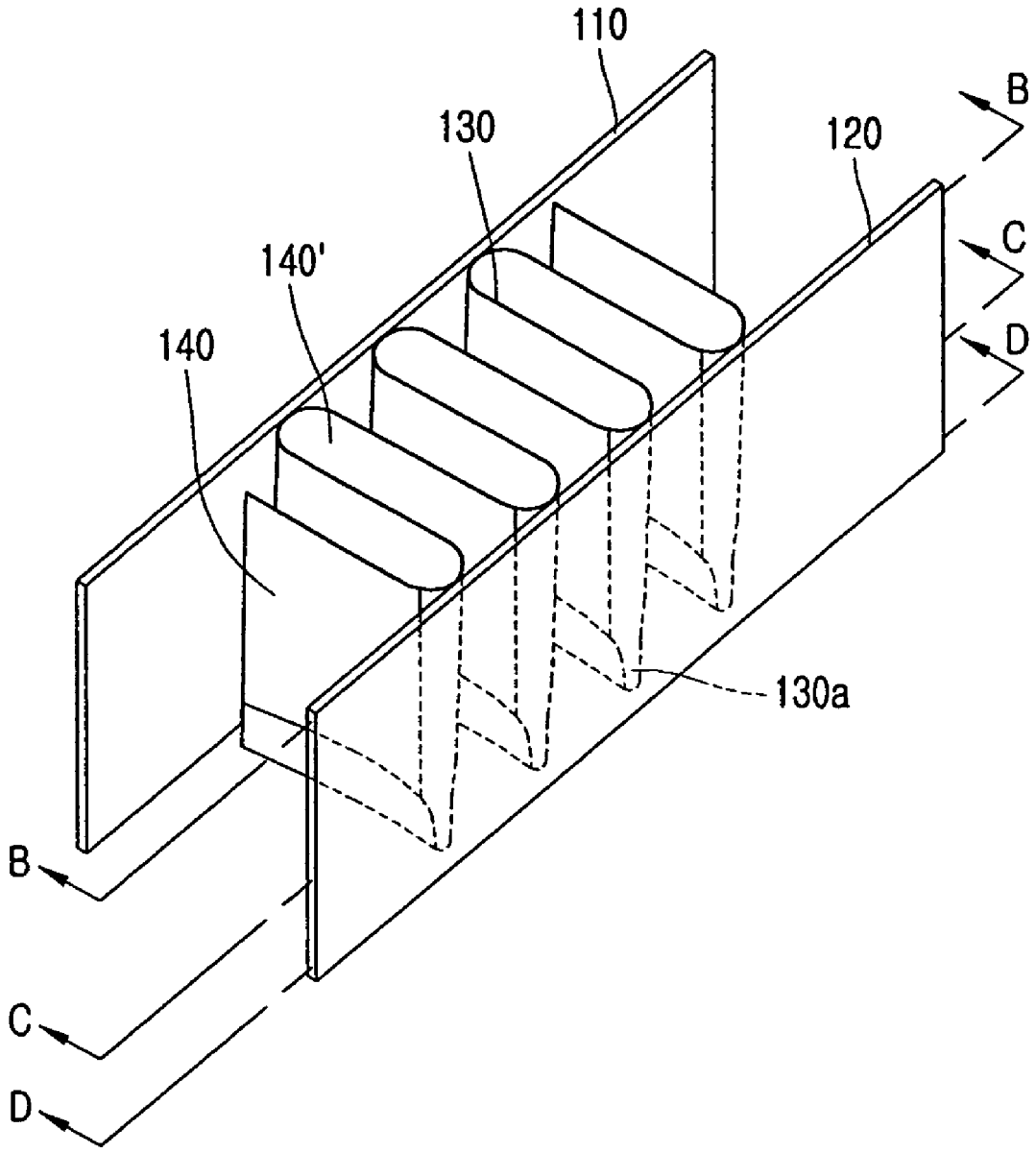
Figure 10A:
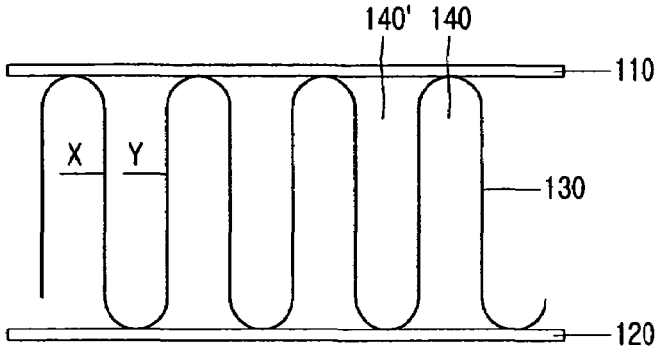
FIG. 10A is a sectional view of the louver fin taken along line B-B of FIG. 9.
Figure 10B:
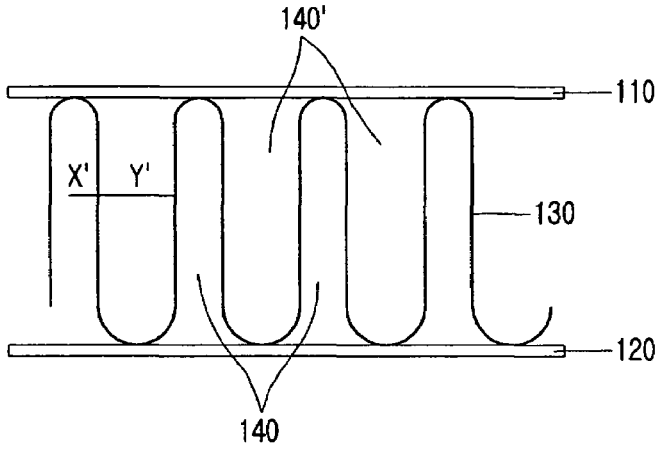
FIG. 10B is a sectional view of the louver fin taken along line C-C of FIG. 9.
Figure 10C:
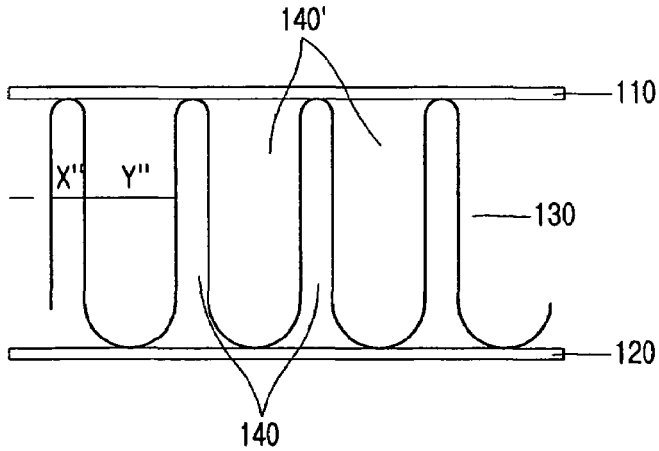

FIGS. 6 to 10C are views which illustrate a louver fin type heat exchanger in accordance with one embodiment of the present invention, wherein FIGS. 6 and 7 are schematic views which illustrate a sectional shape of the louver fin taken along line A-A of FIG. 1, FIG. 8 is a graph which illustrates an experimental result of measuring a pressure drop according to the shape of the louver fin of FIG. 6, FIG. 9 is a perspective view of FIG. 6, FIG. 10A is a sectional view of the louver fin taken along line B-B of FIG. 9, FIG. 10B is a sectional view of the louver fin taken along line C-C of FIG. 9, and FIG. 10C is a sectional view of the louver fin taken along line D-D of FIG. 9.

As shown in FIGS. 6 and 7, the louver fin type heat exchanger 100 in accordance with one embodiment of the present invention includes two or more plates 110 and 120 positioned upright vertically with respect to the ground and spaced apart from each other at an interval of about 3 mm, a louver fin unit 130 coupled with the plates 110 and 120 therebetween and having at least one louver fin, and air passages 140 and 140' surrounded by the plates 110 and 120 and the louver fin unit 130, in which heat exchange between the louver fin unit 130 and external air flowing in an out from the passages occurs.

Each plate 110, 120 is made of an aluminum material having good heat conductivity. Although only a pair of plates are shown in FIGS. 6 and 7, more plates, for example, tens of plates are commonly used.

The louver fin unit 130 is formed of an aluminum material having good heat conductivity and has a wave pattern. A plurality of louvers 131*a* are formed on a surface of the louver fin unit 130, and through holes 131 formed between the louvers 131 communicate with adjacent air passages 140, 140', so that efficient heat exchange can occur between the air introduced from the outside and the louver fin unit 130. Here, the wave pattern of the louver fin unit 130 may be formed to have various-sized pitches, but in general, the pitches (x, y) of the louver fin unit 130 are about three times to eight times greater than the interval between the plates 110 and 120.

Here, lower end portions 130*a* of the louver fin unit 130 close to the ground are formed to be bent toward each other in an alternating manner. Namely, as shown in FIG. 10A, pitches (x, y) of the louver fin unit 130 is constant at upper end portions of the louver fin unit 130 which are not bent. However, as shown in FIGS. 10B and 10C, the bent portions of the lower end portions of the louver fin unit 130 are formed such that pitches (x', y', x", y") of the louver fin unit 130 are alternatingly narrower and wider. Accordingly, the cross-section areas of the air passages 140, 140' close to the ground are alternatingly narrower or wider. Thus, when the louver fin type heat exchanger 100 is positioned upright, inclined with respect to the ground, moisture flowing down along the air passages 140, 140' is introduced to and congregates at end portions (A) having a narrower cross-section area, and moisture 199 does not congregate at end portions (A') of the louver fin 130 having a relatively wider cross-section area.

Accordingly, as shown in FIG. 6, when the air performs heat exchange while passing upwardly from the ground through the heat exchanger 100 and moisture 199 flows down in the gravity direction, the moisture congregates to a certain height only at the narrower end portions (A) of the louver fin 130. For this reason, the external air is smoothly introduced into the air passage 140' through the wider end portions of the louver fin 130, and the air introduced from the outside is dispersed to an adjacent air passage 140 through the through hole 131 of the louver fin 130, so that the heat exchange occurs in an entire louver fin type heat exchanger 100. Namely, although the moisture congregates at the end portions of the louver fin 130, a pressure drop of the air passing through the heat exchanger 100 may be minimized, thereby implementing efficient heat exchange.

Likewise, as shown in FIG. 7, if the air penetrates the heat exchanger 100 downwardly from an upper side toward the ground, the air uniformly introduced through the air passages 140, 140' having the uniform cross-section areas flows to adjacent air passages 140, 140' through the through holes 131 of the louver fin unit 130 while passing the air passage of the louver fin type heat exchanger 100, thereby exchanging heat with the louver fin type heat exchanger 100. Here, when the moisture 199 condensed or applied flows down to the lower end portions of the louver fin unit 130 in the direction of gravity, the moisture congregates to a certain height only at the narrower end portions (A) of the louver fin unit 130. Thus, the air within the heat exchanger 100 is smoothly discharged to the outside through the wider end portions (A') of the louver fin unit 130. Accordingly, a pressure drop of the air passing through the heat exchanger 100 is minimized and efficient heat exchange can be implemented.

FIG. 8 is a graph which illustrates a result of measuring the amount of pressure drop of the air according to a shape of the conventional louver fin and a shape of the louver fin of FIG. 6. By the experimental result of FIG. 8, it can be known that, if the lower end portions of the louver fin 130 are formed to be bent, the amount of a pressure drop of the air can be greatly reduced as compared to by the shape of the conventional louver fin shape.

The louver fin type heat exchanger 200 in accordance with another embodiment of the present invention will now be described.

Only, in describing another embodiment of the present invention, the same or similar reference numerals are designated to the same or similar structures and parts as those of the aforementioned one embodiment, and the detailed description thereon will be omitted.

Figure 11:
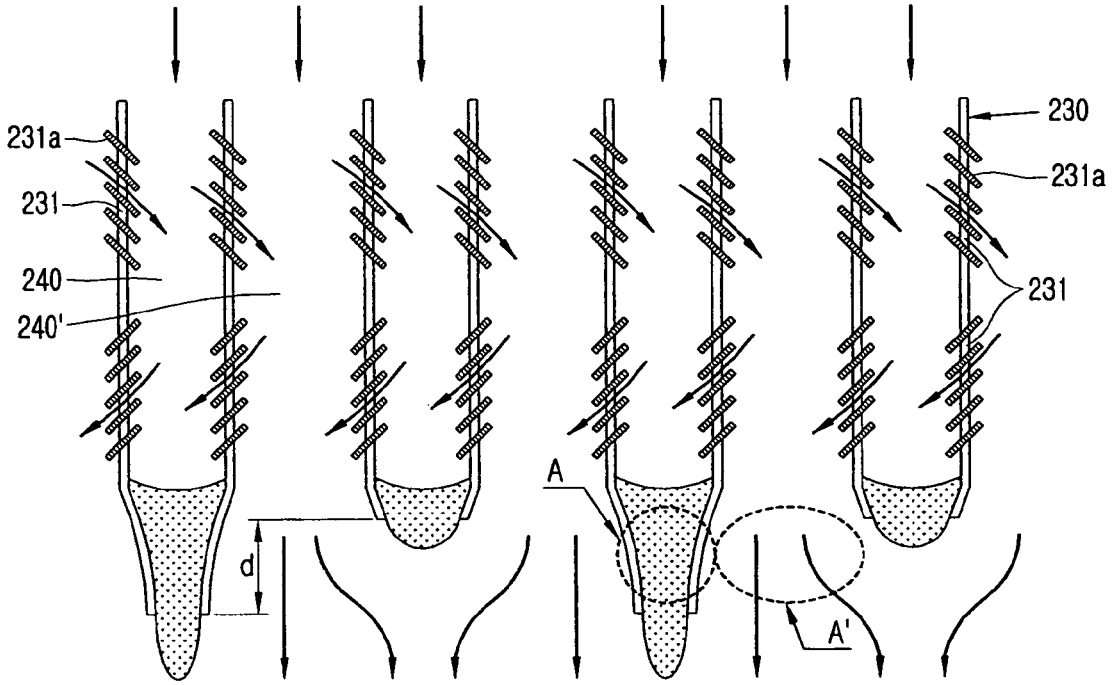

As shown in FIG. 11, the louver fin type heat exchanger 200 is different from the louver fin type heat exchanger 100 in that lower end portions 230*a* of the louver fin unit 230 close to the ground are alternatingly and thusly have an offset of 'd' shown in the drawing with respect to adjacent lower end portions 230*a* of the louver fin unit 230.

In the louver fin type heat exchanger 200 constructed in the aforementioned manner, pitches of the fin unit are small. For this reason, although moisture congregates at end portions (A') of the louver fin unit 130 formed to have the wider cross-section area as in one embodiment 100, such water blockage that interrupts the passage of the air into the heat exchanger can be prevented. Namely, as shown in FIG. 11, moisture flowing down through the air passages 240, 240' congregates at narrower end portions of the louver fin unit 230. Here, because of an offset (d) between the wider lower end portion (A') of the louver fin unit 230 and the narrower lower end portion (A) of the louver fin unit 230, a distance between the end portions (A and A') of the louver fin unit is longer than a separation distance which might cause moisture to congregate (water blockage) 299, 299'. Thusly, the moisture congregates only at the narrower lower end portions (A) of the louver fin unit 230 and does not congregate at the wider lower end portions (A') of the louver fin unit 230, so that external air can pass the air passage 240' through the wider lower end portions (A') of the louver fin unit 230.

Such a louver fin unit 230 is manufactured by alternately cutting the lower end portions of the louver fin 130 in accordance with one embodiment.

Figure 12:
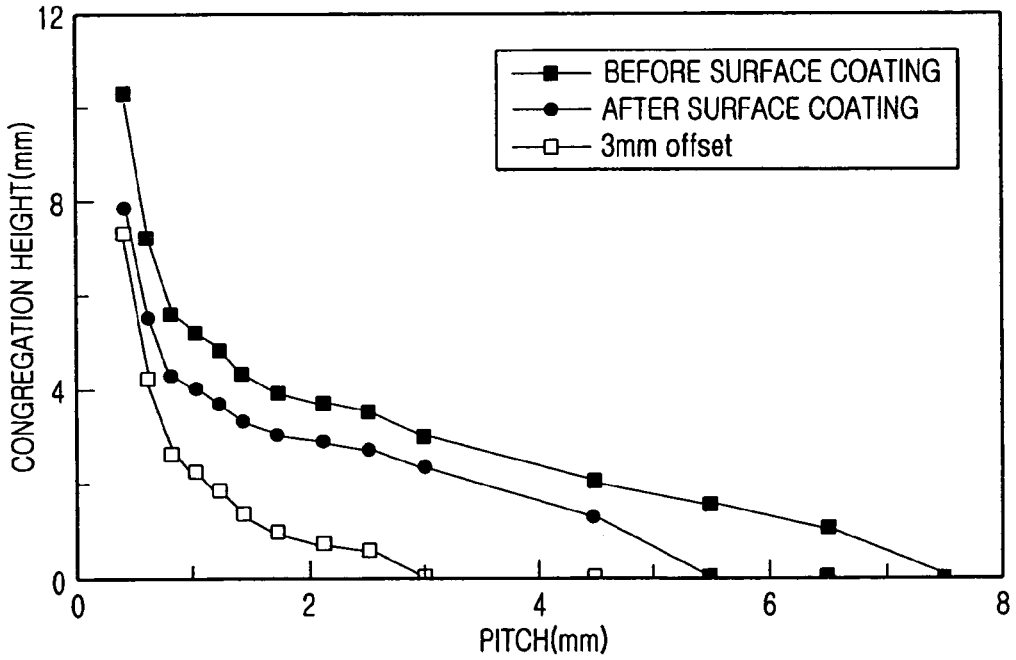

FIG. 12 is a graph which illustrates an experimental result of measuring the height of congregating moisture according to the case where the lengths of the lower end portions of the louver fin unit 130 are formed to be different. As shown in FIG. 12, if the bent portions of the louver fin unit 230 are cut to have an offset of about 3 mm as compared to adjacent bent portions 230, the height of the moisture congregating at the lower end portions of the louver fin unit 230 can be greatly reduced as compared to the case where only the hydrophilic surface coating is performed on the louver fin 230. Accordingly, as the lengths of the lower end portions of the louver fin unit 130 are different in an alternating manner, the moisture is prevented from congregating even when the fin unit have extremely small pitches of 1.5 m or less, and a pressure drop of the air can be minimized.

Also, although not shown in FIG. 12, if the louver fin unit 230 has very small pitches of 1.5 mm, the lower end portions 230*a* of the louver fin unit 230 are formed to have an offset (d) of about 3 mm to 12 mm. Then, the pressure drop of the air occurring due to the congregation moisture (water blockage) can be greatly restricted.

As described so far, in the louver fin type heat exchanger positioned upright at a certain angle with respect to the ground, lower end portions of the louver fin unit close to the ground are bent toward adjacent lower end portions of the louver fin unit, such that the air passage at the lower end portion close to the ground has cross-section areas that are wide at certain portions and are narrow at other portions thereof. Accordingly, moisture congregates (i.e., water blockage occurs) only at the air passage with a small cross-section area and does not congregate at the air passage with a large cross-section area. Thusly, minimizing a pressure drop, the external air smoothly passes into the heat exchanger through the air passages where the moisture does not congregate (i.e., the water blockage does not occur), so that the louver fin type heat exchanger has the improved heat exchange efficiency.

Also, according to the present invention, even in a compact louver fin type heat exchanger having a fin unit with small pitches of 0.5 mm to 5 mm, lower end portions of the louver fin unit close to the ground are formed to have an offset longer than that of other lower end portions thereof. Accordingly, the moisture congregates only at the air passage having a small cross-section area and does not occur at the air passage having a large cross-section area, so that the amount of a pressure drop of the air passing through the heat exchanger is minimized and the improved heat exchange efficiency is secured.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A louver fin type heat exchanger comprising two or more plates respectively spaced apart from each other and positioned upright at a certain angle with respect to the ground, and a louver fin unit with a wave-pattern cross-section inserted between the plates, whereby an air passage is formed in the spaces between the plates and each louver fin of the louver fin unit, the heat exchanger characterized in that:

the louver fin unit having at least one louver fin with a lower end portion close to the ground being formed to be bent towards an adjacent louver, such that the air passage at the lower end portion close to the ground has cross-section areas that are wide at certain portions and are narrow at the other portions thereof.

2. The heat exchanger of claim 1, wherein the lower end portions of the louver fins close to the ground are bent towards the lower end portions of adjacent louver fins to be closer together or further apart in an alternating manner, such that the cross-section areas of the lower end portions of the air passage close to ground are alternatingly narrower and wider.

3. The heat exchanger of claim 2, wherein a plurality of flow passages are formed between the louvers on the louver fins so as to allow the air to flow between the finned channels.

4. The heat exchanger of claim 2, wherein the lower end portions close to the ground of a part of louver fins are longer than those of the other louver fins.

5. The heat exchanger of claim 4, wherein the lower end portions close to the ground of a part of the louver fins are longer than or shorter than those of adjacent louver fins, such that the lengths of the air passages of the lower end portions close to the ground are alternatingly longer and shorter.

6. The louver fin type heat exchanger of claim 1, wherein the plates are positioned upright at an angle of 75°~90° with respect to the ground.

7. The louver fin type heat exchanger of claim 1, wherein hydrophilic surface coating is performed on at least one of the plates and the louver fin unit.

8. The louver fin type heat exchanger of claim 1, wherein a gap between the fins is 0.5 mm~5 mm.

9. The louver fin type heat exchanger of claim 1, wherein the plates and the louver fins are made of an aluminum material.

10. The heat exchanger of claim 1, wherein the plates and the louver fin unit are formed of an aluminum material.

11. A louver fin type heat exchanger comprising two or more plates respectively spaced apart from each other and positioned upright at a certain angle with respect to the ground, and a louver fin unit with a wave-pattern cross-section inserted between the plates, whereby an air passage is formed in the spaces between the plates and each louver fin of the louver fin unit, the heat exchanger characterized in that:

the lower end portions close to the ground of a part of louver fins are longer than those of the other louver fins.

12. The heat exchanger of claim 11, wherein the lower end portions close to the ground of the louver fins are longer than or shorter than the those of adjacent louver fins, such that the lower end portions close to the ground are alternatingly longer and shorter.

13. The heat exchanger of claim 12, wherein the length difference between the louver fins is 3 mm or greater.

14. The heat exchanger of claim 13, wherein a plurality of flow passages are formed between the louvers on the louver fins so as to allow the air to flow between the finned channels.

15. The heat exchanger of claim 12, wherein the lower end portions of the louver fins close to the ground are bent toward the lower end portions of adjacent louver fins, such that the air passage at the lower end portion close to the ground has cross-section areas that are wide at certain portions and are narrow at other portions thereof.

16. The heat exchanger of claim 15, wherein the lower end portions of the louver fins close to the ground are bent toward the lower end portions of adjacent louver fins to be closer together or further apart in an alternating manner, such that the cross-section areas of the lower end portions of the air passage close to the ground are alternatingly narrower and wider.

17. The heat exchanger of claim 11, wherein the plates are positioned upright at an angle of 75°~90° with respect to the ground.

18. The heat exchanger of claim 11, wherein hydrophilic surface coating is performed on at least one of the plates or the louver fin unit.

19. The heat exchanger of claim 11, wherein an interval between the fins is 0.5 mm~5 mm.

* * * * *